US009073107B2

(12) United States Patent
Schmidt

(10) Patent No.: US 9,073,107 B2
(45) Date of Patent: Jul. 7, 2015

(54) ROLLING METHOD HAVING OPTIMIZED STRAIN PENETRATION

(75) Inventor: Birger Schmidt, Brand-Erbisdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 528 days.

(21) Appl. No.: 13/498,187

(22) PCT Filed: Sep. 21, 2010

(86) PCT No.: PCT/EP2010/063915

§ 371 (c)(1),
(2), (4) Date: Mar. 26, 2012

(87) PCT Pub. No.: WO2011/036156

PCT Pub. Date: Mar. 31, 2011

(65) Prior Publication Data

US 2012/0180540 A1 Jul. 19, 2012

(30) Foreign Application Priority Data

Sep. 24, 2009 (EP) ..... 09171252

(51) Int. Cl.
*B21B 37/16* (2006.01)
*B21B 1/32* (2006.01)

(52) U.S. Cl.
CPC . *B21B 37/16* (2013.01); *B21B 1/32* (2013.01); *B21B 2201/06* (2013.01); *B21B 2261/04* (2013.01); *B21B 2265/22* (2013.01)

(58) Field of Classification Search
CPC ..... B21B 37/16; B21B 37/165; B21B 1/32; B21B 2201/06; B21B 2261/04; B21B 2265/22
USPC ..... 72/18.8, 19.6, 201
See application file for complete search history.

(56) References Cited

U.S. PATENT DOCUMENTS 5,771,731 A 6/1998 Rohde et al. ..... 72/200
5,802,902 A 9/1998 Rosenthal et al. ..... 72/201

(Continued)

FOREIGN PATENT DOCUMENTS

CN 1151912 A 6/1997 ..... B21B 1/26
CN 1153685 A 7/1997 ..... B21B 1/26

(Continued)

OTHER PUBLICATIONS

Jinzhi, Zhang et al., "On-Line Set-Up Method of Medium and Heavy Plate Rolling Optimizing Schedule," 9 pages (Chinese w/ English abstract), Jun. 30, 2001.

(Continued)

*Primary Examiner* — Debra Sullivan
(74) *Attorney, Agent, or Firm* — Slayden Grubert Beard PLLC

(57) ABSTRACT

A flat rolling stock is first rolled in a rolling mill from an initial thickness to an intermediate thickness, and then from the intermediate thickness to a final thickness. In order to roll the rolling stock from the initial thickness to the intermediate thickness, a number of reduction stages is determined and the rolling stock is rolled accordingly. Further, a permissible thickness range for the intermediate thickness is set using technological boundary conditions. The reduction stages are determined such that the intermediate thickness is within the permissible thickness range and either the performance limits of the rolling mill are completely utilized in every reduction stage, or not completely utilized in at least one reduction stage; however, in the event that the number of reduction stages were reduced by one, the intermediate thickness would be outside of the permissible thickness range, although the performance limits of the rolling mill would be completely utilized for all reduction stages.

18 Claims, 4 Drawing Sheets

(56) References Cited

U.S. PATENT DOCUMENTS

| | | | | |
|---|---|---|---|---|
| 6,305,206 | B1 | 10/2001 | Kobayashi | 72/229 |
| 6,533,876 | B1 * | 3/2003 | Cornelissen et al. | 148/541 |
| 2012/0180540 | A1 | 7/2012 | Schmidt | 72/19.6 |

FOREIGN PATENT DOCUMENTS

| | | | | |
|---|---|---|---|---|
| CN | 1287032 | A | 3/2001 | B21B 1/32 |
| JP | 6262225 | A | 9/1994 | B21B 37/00 |
| JP | 7232205 | A | 9/1995 | B21B 37/00 |
| JP | 2749754 | B2 | 5/1998 | B21B 37/00 |
| JP | 2998550 | B2 | 1/2000 | B21B 37/00 |
| WO | 2011/036156 | A2 | 3/2011 | B21B 37/16 |

OTHER PUBLICATIONS

Yuntao, Zhao et al., "Application of Multilayer Ant Colony Algorithm in Load Distribution of Medium Plate," Journal of Wuhan University Science and Technology, vol. 32, No. 4, 5 pages (Chinese w/ English abstract), Aug. 2009.

Chinese Office Action, Application No. 201080042615.0, 9 pages, Nov. 5, 2013.

European Search Report, European Patent Application No. 09171252.1-2302, 7 pages, Apr. 6, 2010.

International PCT Search Report and Written Opinion, PCT/EP2010/063915, 12 pages, Sep. 19, 2011.

Neumann, H.H. et al., "Pass Schedule Optimization in Cold Rolling Mills," Elektrie, vol. 47, No. 2, 8 pages (German language w/ English translation), Jan. 1, 1993.

Fazan, Bernard et al., "Optimum Computer Control of a Plate Mill," Iron and Steel Engineer, pp. 58-64 (7 pages) Nov. 1980.

Lederer, Andreas, "Process-Engineering Aspects of Thermomechanical Rolling," Bander Bleche Rohre Jun. 1982, Henrich Publikationen GmbH, pp. 153-157 (11 pages) (German language w/ English translation) 1982.

Lederer, "Metallurgical Aspects of Thermomechanical Rolling," Bander Bleche Rohre May 1982, pp. 117-120 (11 pages) (German language w/ English translation) 1982.

Liang, S.C. et al., "Advanced Technology at China Steel No. 2 Hot Strip Mill," METEC 99, ISSN: 3-514-00634-2, pp. 218-225 (8 pages) Jun. 13, 1999.

Sixtensson, Par et al., "New Process Technologies and Automation Systems for Hot Rolling Mills," Hot Flat Rolling Mills Division, SMS Demag Joint-Stock Company, 15 pages. Jun. 13, 1999.

Groch, Andrzej, "Model Based Rolling Schedules for Steckel Mills," AISTech2008, 10 pages. May 5, 2008.

Streilβelberger et al., "Heavy Plate Production from a Process Technology Point of View," Grobblech — Herstellung and Anwendung, ISSN: 0175-2006, pp. 7-16 (20 pages) (German language w/ English translation) Nov. 2001.

* cited by examiner

ROLLING METHOD HAVING OPTIMIZED STRAIN PENETRATION

CROSS-REFERENCE TO RELATED APPLICATIONS

This application is a U.S. National Stage Application of International Application No. PCT/EP2010/063915 filed Sep. 21, 2010, which designates the United States of America, and claims priority to EP Patent Application No. 09171252.1 filed Sep. 24, 2009. The contents of which are hereby incorporated by reference in their entirety.

TECHNICAL FIELD

The present disclosure relates to an operating method for a rolling mill for rolling flat rolling stock from an initial thickness to a final thickness, wherein the rolling stock is firstly rolled from the initial thickness to an intermediate thickness, a rolling pause is then inserted and only then is the rolling stock rolled from the intermediate thickness to the final thickness, wherein, for rolling the rolling stock from the initial thickness to an intermediate thickness, a number of reduction stages are determined and the rolling stock is rolled in accordance with the determined reduction stages.

The present disclosure further relates to a computer program having machine code that is able to be processed directly by a control device for a rolling mill for flat rolling stock and the processing of which by the control device causes the control device to control the rolling mill in accordance with an operating method of this type.

The present disclosure further relates to a control device for a rolling mill for flat rolling stock, which is embodied such that it controls the rolling mill during operation in accordance with an operating method of this type.

Finally the present disclosure relates to a rolling mill for flat rolling stock which is controlled by a control device of this type.

BACKGROUND

In what is referred to as thermo-mechanical rolling of coarse steel the rolling process attempts to produce a structure which is as fine-grained as possible, in order to optimize the mechanical properties of the end product. The rule of thumb applies that the mechanical properties are all the better, the finer the grain is. The principle of thermo-mechanical rolling consists of destroying the coarse grain which forms during the heating up of the coarse sheet to be rolled or during rolling at high temperatures, by reshaping to the intermediate thickness and to prevent a growth in grain by temperature reduction. It is typically important in this context to reshape the material completely (strain penetration), in order also to influence the structure in the material core. This may be done most effectively by reshaping which is as great as possible per stage. If it is not possible to work with maximum reshaping in all stages, the stages before the cooling pauses and in the rolling phases with low temperature are preferably maximized.

In order to achieve the highest possible degrees of deformation, the use of especially large and strong roll stands and roll drives is known in the art. However, these measures are typically very cost intensive and cannot be used for modernization projects in particular. As an alternative or in addition an attempt can be made with adjustment elements which influence the course of the rolling gap (for example roles displacement and roll deflection) to keep the level of the rolling force high up to the last reduction stages. Both measures nevertheless shift the limit up to which deformation can take place, a deformation limit still remains which cannot be exceeded.

A method is also known in which an attempt is made to roll the rolling stock in consecutive stages with increased rolling forces to the intermediate thickness. This method is named after its inventor (Malcolm Gray). The basic idea of this method is to maximize the deformation and thus the strain penetration up to the end of rolling from stage to stage, since here the effect in respect of the structure formation is at its greatest. If it can be carried out without modification the method leads to results which are better than those of the conventional method described above. If however problems arise during rolling which lead to an unforeseen increase in the required rolling force or the like, the method is significantly worse than other conventional techniques. This is because in this case a further stage with generally only a small degree of deformation must be added to the path carried out with a high degree of deformation so that the desired intermediate thickness is obtained.

SUMMARY

In one embodiment, an operating method is provided for a rolling mill for rolling a flat rolling stock from an initial thickness to a final thickness, wherein the rolling stock is first rolled from the initial thickness to an intermediate thickness, then a rolling pause is inserted and only then is the rolling stock rolled from the intermediate thickness to the final thickness, wherein for rolling the rolling stock from the initial thickness to the intermediate thickness a number of reduction stages is determined and the rolling stock is rolled in accordance with the reduction stages determined, wherein before the rolling stock is rolled, a permitted thickness range is determined on the basis of technological boundary conditions, within which the intermediate thickness should lie, and that the reduction stages are determined such that the intermediate thickness lies within the permitted thickness range and: either the performance limits of the rolling mill are fully utilized in all reduction stages, or, although in at least one of the reduction stages the performance limits of the rolling mill are not fully utilized, in the case in which the number of reduction stages would be reduced by one however, the intermediate thickness would lie outside the permitted thickness range, although for all of the number of reduction stages reduced by one the performance limits of the rolling mill would be fully utilized.

In a further embodiment, a target thickness lying within the permitted thickness range is predetermined and, in the event of the performance limits of the rolling mill being fully utilized for all reduction stages, the number of reduction stages is determined such that a difference between the intermediate thickness produced and the target thickness is minimized. In a further embodiment, in the event of the performance limits of the rolling mill not being fully utilized in at least one of the reduction stages, the intermediate thickness lies at the lower limit of the permitted thickness range. In a further embodiment, in the event of the performance limits of the rolling mill not being fully utilized in at least one of the reduction stages the reduction stages not fully utilizing the performance limits of the rolling mill are the last of the reduction stages. In a further embodiment, the rolling stock during rolling from the initial thickness to the intermediate thickness is rolled longitudinally and during rolling from the intermediate thickness to the final thickness is rolled at least partly transversely and that the permitted thickness range is determined by a permitted longitudinal or transverse range of the rolling stock within which the corresponding dimension of the rolling stock should lie after it is rolled to its final thickness. In a further embodiment, the rolling stock both during rolling from the initial thickness to the intermediate thickness and also during rolling from the intermediate thickness to the final thickness is rolled longitudinally and that the permitted thickness range is determined by the technical facilities of the rolling mail for rolling the rolling stock to the final thickness after the rolling pause.

In a further embodiment, the rolling from the initial thickness to the intermediate thickness is undertaken in a first temperature range, but the rolling stock cools down during the rolling pause and that the rolling from the intermediate thickness to the final thickness is undertaken in at least one second temperature range. In a further embodiment, the rolling from the intermediate thickness to the final thickness is undertaken in more than one second temperature range and that between two respective directly consecutive second temperature ranges lies a further rolling pause in which the rolling stock cools down.

In another embodiment, a computer program comprising machine code is directly executable by a control device for a rolling mail for a flat rolling stock, the execution of which by the control device causes the control device to control the rolling mill such that the rolling stock is first rolled from the initial thickness to an intermediate thickness, then a rolling pause is inserted and only then is the rolling stock rolled from the intermediate thickness to the final thickness, wherein for rolling the rolling stock from the initial thickness to the intermediate thickness a number of reduction stages is determined and the rolling stock is rolled in accordance with the reduction stages determined, wherein before the rolling stock is rolled, a permitted thickness range is determined on the basis of technological boundary conditions, within which the intermediate thickness should lie, and that the reduction stages are determined such that the intermediate thickness lies within the permitted thickness range and: either the performance limits of the rolling mill are fully utilized in all reduction stages, or, although in at least one of the reduction stages the performance limits of the rolling mill are not fully utilized, in the case in which the number of reduction stages would be reduced by one however, the intermediate thickness would lie outside the permitted thickness range, although for all of the number of reduction stages reduced by one the performance limits of the rolling mill would be fully utilized.

In a further embodiment, the computer program is stored on a data medium in machine-readable form.

In another embodiment, a control device for a rolling mill for a flat rolling stock is embodied such that in operation it controls the rolling mill in accordance with an operating method wherein the rolling stock is first rolled from the initial thickness to an intermediate thickness, then a rolling pause is inserted and only then is the rolling stock rolled from the intermediate thickness to the final thickness, wherein for rolling the rolling stock from the initial thickness to the intermediate thickness a number of reduction stages is determined and the rolling stock is rolled in accordance with the reduction stages determined, wherein before the rolling stock is rolled, a permitted thickness range is determined on the basis of technological boundary conditions, within which the intermediate thickness should lie, and that the reduction stages are determined such that the intermediate thickness lies within the permitted thickness range and: either the performance limits of the rolling mill are fully utilized in all reduction stages, or, although in at least one of the reduction stages the performance limits of the rolling mill are not fully utilized, in the case in which the number of reduction stages would be reduced by one however, the intermediate thickness would lie outside the permitted thickness range, although for all of the number of reduction stages reduced by one the performance limits of the rolling mill would be fully utilized. In another embodiment, a rolling mill for a flat rolling stock is controlled by such a control device.

BRIEF DESCRIPTION OF THE DRAWINGS

Example embodiments will be explained in more detail below with reference to figures, in which.

DETAILED DESCRIPTION

Figure 1:
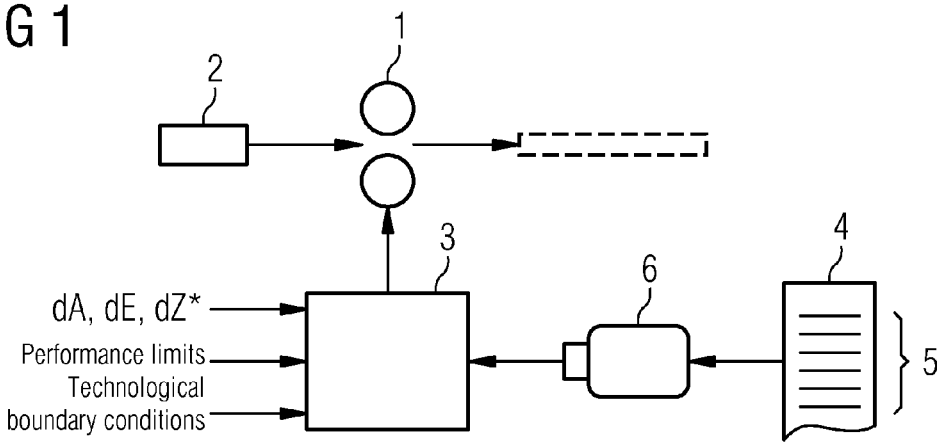
FIG. 1 illustrates a rolling mill from the side, according to an example embodiment.

Some embodiments provide a good strain penetration in a simple and reliable manner.

For example, some embodiments provide an operating method such that before the rolling stock is rolled, an allowable range of thicknesses is defined on the basis of technological boundary conditions within which the intermediate thickness is to lie, that the reduction stages are determined such that the intermediate thickness lies within the permitted thickness range, and

- either the performance limits of the rolling mill are fully utilized for all reduction stages
- or the performance limits of the rolling mill are not fully utilized for all reduction stages but in the event of the number of reduction stages being reduced by one the intermediate thickness would lie outside the permitted thickness range although for all of the number of reduction stages reduced by one the performance limits of the rolling mill would be fully utilized.

In some embodiments a window for the intermediate thickness is thus created. This makes it possible in most cases to carry out all reduction stages before the rolling interval with maximum deformation. The necessary reduction of the deformation necessary without this thickness window can be dispensed with.

The thickness window (in the terminology of the present disclosure: the permitted thickness range) must not be confused with the unavoidable manufacturing tolerance. This is because the manufacturing tolerance is a (relatively small) error which cannot be avoided because of manufacturing conditions. For example a material thickness of 70 mm is to be set. Despite all precision the material thickness fluctuates however typically between 69.5 mm and 70.5 mm. It is predetermined however for the permitted thickness range that for example the intermediate thickness should lie in a range which is significantly greater than the manufacturing-related tolerances. For example it is determined that the intermediate thickness should lie between 65 mm and 75 mm. The manufacturing-related tolerances are not taken into account in this case. The permitted range of thicknesses thus does not involve a range within which the actual thickness of the rolling stock lies, but involves a permitted setpoint thickness range within which the setpoint intermediate thickness of the rolling stock lies.

In many cases a target thickness is predetermined which is to be aimed for where possible. The target thickness in this case obviously lies within the permitted thickness range or—expressed conversely—the permitted thickness range is defined around the target thickness. If with this type of arrangement the case occurs in which several numbers of reduction stages are possible, so that in all reduction stages the performance limits of the rolling mill are fully utilized and the intermediate thickness produced in each case lies within the permitted thickness range, the number of reduction stages is preferably determined such that a difference between the intermediate thickness produced and the target thickness will be minimized.

In the case in which at least one of the reduction stages does not fully utilize the performance limits of the rolling mill, the intermediate thickness preferably lies at the lower limit of the permitted thickness range. This is because it is possible in this case to only reduce the performance limits of the rolling mill as little as possible.

In the event of the performance limits of the rolling mill not being completely utilized during at least one of the reduction stages it is further preferred that the reduction stages not fully utilizing the performance limits of the rolling mill are the last of the reduction stages. The result is able to be achieved by this is that, in the event of unforeseen problems during rolling operation, a reserve (even if mostly only a small reserve) remains.

It is possible for the rolling stock during rolling from the initial thickness to the intermediate thickness to be rolled longitudinal and during rolling from the intermediate thickness to the final thickness to be rolled at least partly transversely. In this situation the case often occurs in which the length and/or the width of the rolling stock must lie within a permitted longitudinal or transverse range of the rolling stock. Especially in this case it is possible for the permitted thickness range to be defined by the corresponding permitted longitudinal or transverse range of the rolling stock, within which the corresponding dimension of the rolling stock should lie after it is rolled to the final thickness.

As an alternative it is possible for the rolling stock both during rolling from the initial thickness to the intermediate thickness and also doing rolling from the intermediate thickness to the final thickness, to be rolled longitudinally. In this case the permitted range of thicknesses is determined as a rule by the technological facilities of the rolling mill for rolling the rolling stock to the final thickness after the rolling pause.

As a rule the rolling stock is rolled from the initial thickness to the intermediate thickness in a first temperature range. During the rolling pause the rolling stock cools down. The stock is subsequently rolled from the intermediate thickness to the final thickness in at least one second, lower temperature range.

In some cases the stock is rolled from the intermediate thickness to the final thickness in more than one second temperature range. In this case there is a further rolling pause, in which the rolling stock cools down, between two immediately consecutive respective temperature ranges. The intermediate thickness of the respective preceding rolling process corresponds in this case to the initial thickness of the respective rolling process.

Some embodiments provide a computer program including machine code designed for processing by a control device to control the rolling mill as disclosed herein. The computer program may be stored on a data medium in machine-readable form (especially in exclusively machine-readable form, for example electronically).

Some embodiments provide a control device for a rolling mill for a flat rolling stock which is embodied such that during operation it controls the rolling mill as disclosed herein.

Further, some embodiments provide a rolling mill for a flat rolling stock which is controlled by a control device as disclosed herein.

Figure 2:
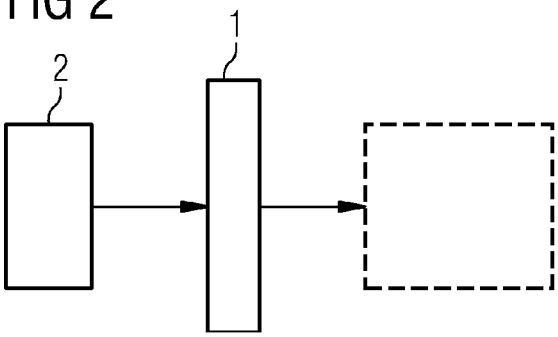
FIG. 2 illustrates the rolling mill of FIG. 1, viewed from above, according to an example embodiment.

In accordance with FIGS. 1 and 2 a rolling mill has at least one roll stand 1. Shown in FIGS. 1 and 2 is a single roll stand 1. It is possible however for more than one roll stand 1 to be present.

Flat rolling stock is rolled in the rolling mill. The term "flat rolling stock" is used to distinguish between profiled rolling stock, bar-shaped rolling stock and tube-shaped rolling stock.

In FIG. 1 the rolling mill is embodied as a reversing rolling mill, in which the flat rolling stock 2 undergoes a reversing rolling process. In other embodiments, the flat rolling stock 2 may pass through a number of roll stands 1 in succession without changing its direction of transport.

The rolling mill has a control device 3 by which it is controlled. The control device 3 may be embodied such that, during operation of the rolling mill, it controls the mill in accordance with an operating method which will be explained in more detail below. In particular the control device 3 may include a processor programmed with a computer program 4 having the machine code 5 which is able to be processed directly by the control device 3. The processing of the machine code 5 by the control device 3 causes the control device 3 to control the rolling mill in this case in accordance with operating methods disclosed herein.

The computer program 4 can be supplied to the control device 3 in different ways. In particular it is possible for the computer program 4 to be stored in machine-readable form on a data medium 6. A USB stick is shown as an example of the data medium 6 in FIG. 1. This embodiment is however purely by way of example. The computer program 4 can also be supplied to the control device 3 in another way than via a data medium 6. For example it is possible to supply the computer program 4 to the control device 3 via a computer-to-computer link, especially a local area network or the World Wide Web.

The flat rolling stock 2 is designed to be rolled in the rolling mill from an initial thickness dA to a final thickness dE. To determine the reduction stages necessary to roll the flat rolling stock 2 and the corresponding control of the rolling mill, the control device 3 may execute a method which is explained below in conjunction with FIG. 3.

Figure 3:
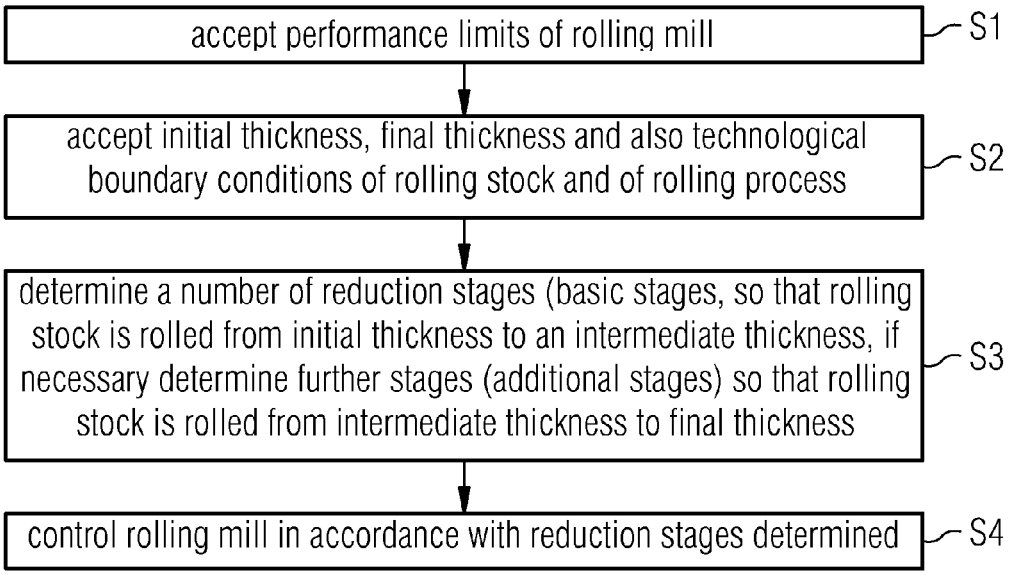
FIG. 3 is a flow diagram, according to an example embodiment.

In accordance with FIG. 3 the control device 3 accepts performance limits of the rolling mill in a step S1. For example the control device 3, for each roll stand 1 of the rolling mill, can accept said roll stand's maximum possible rolling force, its maximum possible rolling moment, its maximum possible bendback force etc.

In a step S2 the control device 3 accepts the (actual) initial thickness dA, the (desired) final thickness dE as well as the technological boundary conditions of the rolling stock 2 and of the rolling process. As an alternative to explicitly specifying the said variables, the variables can also be determined in another way. The decisive factor is that they are known to the control device 3.

In a step S3 the control device 3 determines a number of reduction stages so that the rolling stock 2 is rolled from the initial thickness dA to an intermediate thickness dZ. These reduction stages are referred to as basic stages below in order to differentiate them linguistically from other reduction stages. The choice of words is merely for the purposes of linguistic differentiation. Further meaning content should not be associated with this choice of words.

As a rule the control device 3 determines further stages within the framework of the step S3, so that the rolling stock 2 will be rolled from the intermediate thickness dZ to the final thickness dE. These reduction stages will be referred to below, to distinguish them linguistically from the basic stages, as additional stages. This choice of words merely serves to differentiate the terms linguistically.

In a step S4 the control device 3 controls the rolling mill in accordance with the reduction stages determined in step S3, i.e., in accordance with the basic stages and if necessary also the additional stages.

Figure 4:
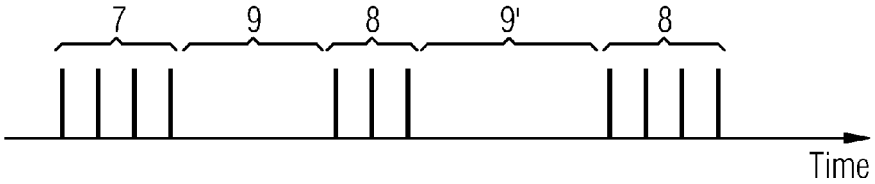
FIG. 4 is a timing diagram, according to an example embodiment.

In accordance with FIG. 4 the basic stages are carried out in a first temporal rolling train segment 7, the additional stages in at least one further temporal rolling train segment 8, Both the basic stages and also the additional stages are indicated in FIG. 4 as vertical lines. Between the first temporal rolling train segment 7 and the first of the further temporal rolling train segment 8 there is a rolling pause 9 in which the rolling stock 2 is not rolled. The rolling pause 9 is a deliberately inserted rolling pause 9. The rolling pause 9 does not just involve an unavoidable pause between two directly consecutive reduction stages which is needed for example for reversing the rolling stock 2. If a number of further rolling segments 8 are present there is a further rolling pause 9' between adjacent segments of the further rolling train segments 8.

By and large the rolling is undertaken in the first temporal rolling train segment 7 at a first temperature of the rolling stock 2 which is relatively high. From rolling train segment 7 to rolling train segment 8 (and if necessary also from rolling train segment 8 to rolling train segment 8) the rolling stock 2 cools down in the respective rolling pause 9, 9'.

Figure 5:
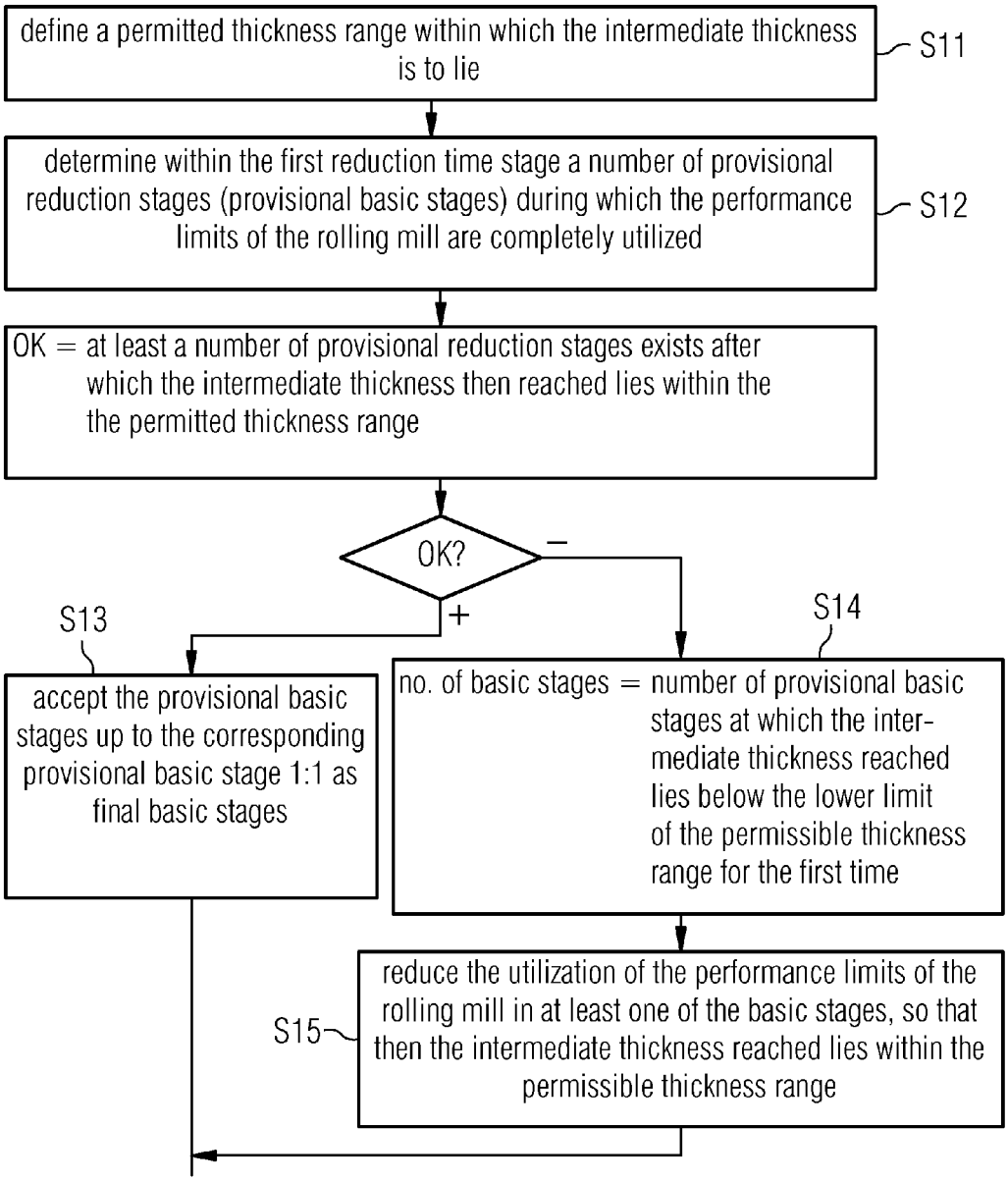
FIG. 5 is a flow diagram, according to an example embodiment.

To determine the basic reduction stages, before the rolling of the rolling stock 2 in accordance with FIG. 5, in a step S11 a permitted thickness range DB is defined within which the intermediate thickness dZ should lie. The thickness range DB is defined by an upper limit dZmax and the lower limit dZmin. The thickness range DB cannot actually be selected arbitrarily if the technological boundary conditions are to be adhered to. The thickness range DB however does not merely involve a tolerance range which is unavoidable in the operation of the rolling mill. Instead it involves a range of which the size is significantly greater than the accuracy with which the rolling stock 2 can be rolled to a specific thickness. For example the difference between upper limit dZmax and lower limit dZmin, in relation to the lower limit dZmin, can lie between 5 percent and 25 percent. Examples of possible thickness ranges DB are shown in FIGS. 6 and 7.

Then, in a step S12 within the first temporal rolling segment 7 a proportion of provisional reduction stages is determined, i.e., provisional basic stages. In each of the provisional basic stages the performance limits of the rolling mill are fully utilized. The provisional basic stages are thus employed as "limit passes" in which the maximum possible deformation is undertaken. The basic stages are thus set in accordance with the motto "roll stand, do what you can". In this case two different situations can arise.

Figure 6:
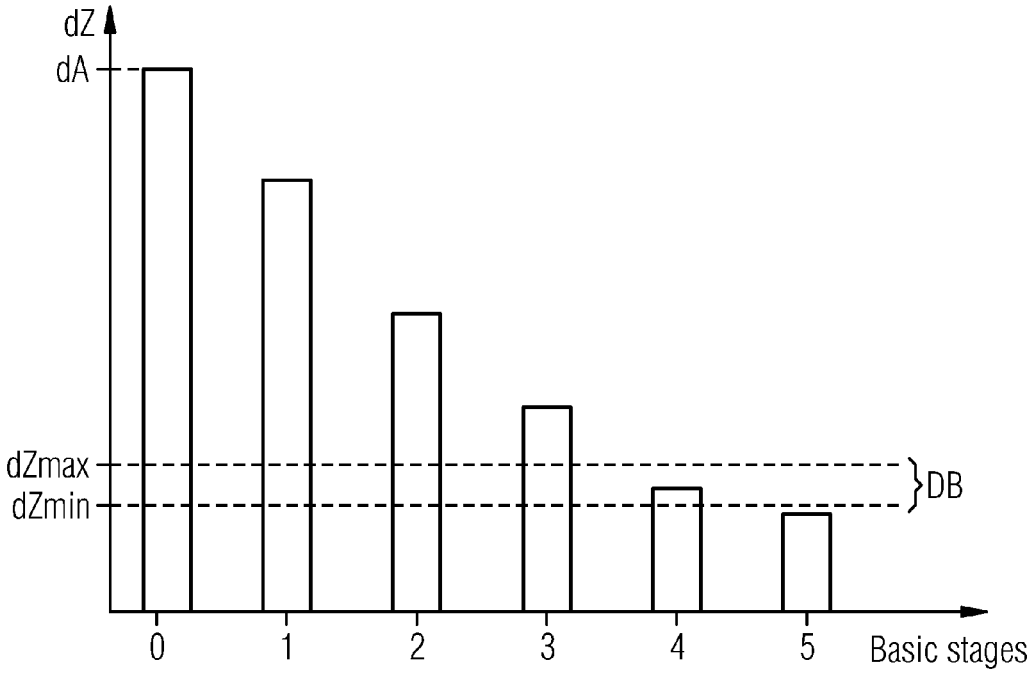
FIGS. 6 to 8 are timing diagrams, according to an example embodiment.
Figure 7:
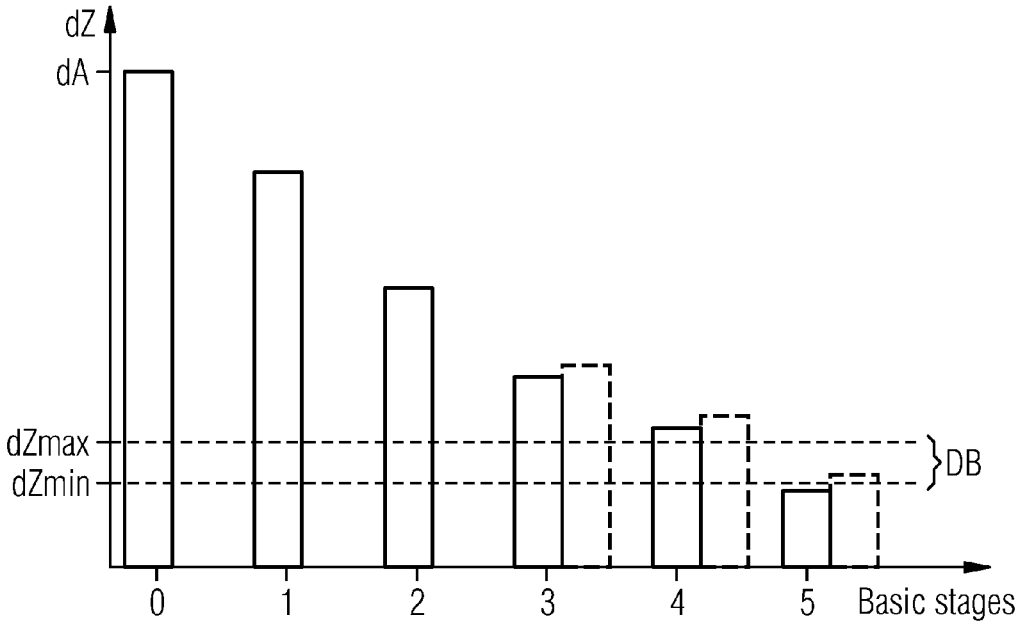

On the one hand it is possible, in accordance with the diagram depicted in FIG. 6, for an intermediate thickness dZ to be reached after at least one of the provisional basic stages—after four reduction stages in the diagram shown in FIG. 6—which lies within the permitted thickness range DB. If this is the case, the provisional stages up to the last mentioned provisional basic stage are accepted 1:1 as final basic stages. This is shown in FIG. 5 in a step S13.

On the other hand it is possible that no such number of provisional basic stages exists. In this case two provisional basic stages exist—in accordance with the diagram shown in FIG. 7 the fourth and the fifth basic stage—wherein the intermediate thickness dZ reached in each case still lies above the upper limit dZmax of the permitted thickness range DB after the fourth basic stage, after the fifth provisional basic stage however it already lies below the lower limit dZmin of the permitted thickness range DB. The permitted thickness range DB is thus bracketed by these two basic stages following immediately after one another.

In this case the number of final basic stages in accordance with a step S14 is equal to the number of provisional basic stages at which the permitted thickness range DB is undershot (i.e., exceeded in the direction of decreasing thickness) the first time (i.e. five basic stages in the diagram in accordance with FIG. 7). The final basic stages can however not correspond 1:1 to the provisional basic stages. Instead it is necessary for at least one of the final basic stages not to fully utilize the performance limits of the rolling mill. This is shown in FIG. 5 in a step S15.

Even if the last explained procedure has to be used, i.e., if at least one of the basic stages does not fully utilize the performance limits of the rolling mill, a highest possible strain penetration should still be achieved. The reduction of the utilization of the performance limits of the rolling mill should thus be as low as possible. For this reason the utilization of the performance limits of the rolling mill should preferably only be reduced far enough for the intermediate thickness dZ to lie in accordance with the diagram shown in FIG. 7 at the lower limit dZmin of the permitted thickness range DB. For example the intermediate thickness dZ can directly correspond to the lower limit dZmin or—in relation to the entire permitted thickness range DB—at least lie in the lower third, preferably far below this, for example in the lower 5 percent or the lower 10 percent of the permitted thickness range DB.

In principle it is also possible to distribute the reduction of the utilization of the performance limits of the rolling mill to any one of the basic stages, for example to all basic stages or to the basic stages at an earlier time. It is preferred however, in accordance with the diagram shown in FIG. 7, for those of the basic stages, for which the performance limits of the rolling mill are not fully utilized, to be the last basic stages in time. In accordance with the diagram shown in FIG. 7 this is for example the third, fourth and fifth final basic stage. This is indicated in FIG. 7 by the fact that in these basic stages, discharge thicknesses of the rolling stock 2 are produced which deviate ever more widely from the minimum possible discharge thickness for the respective stage. These discharge thicknesses are shown by dashed lines in FIG. 7.

Figure 8:
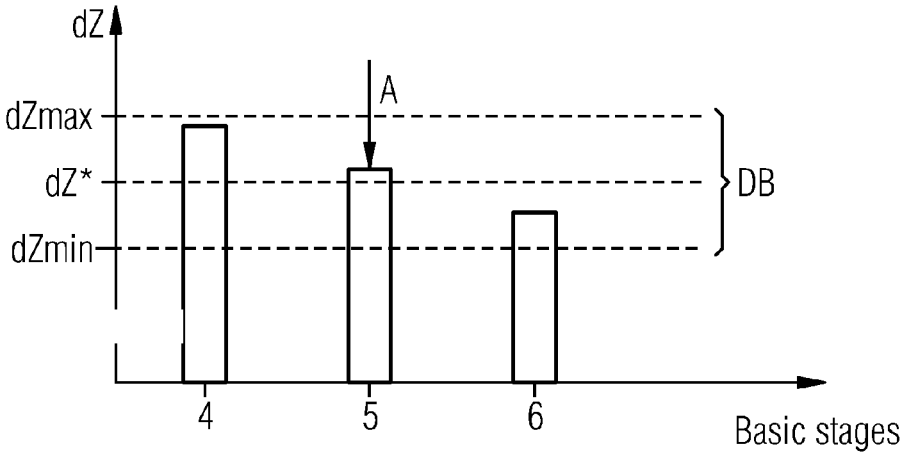

When it is possible to fully utilize the performance limits of the rolling mill for all basic stages, it can occur that the number of basic stages is not uniquely determined. For example, in accordance with the diagram shown in FIG. 8 the intermediate thicknesses dZ reached in each case after 4, 5 and 6 basic stages all lie within the permitted thickness range DB. In this case it is possible in principle to begin the number of basic stages as an alternative with 4, 5 or 6. In many cases however a target thickness dZ* will be predetermined which lies within the permitted thickness range DB. In this case the number of basic stages is preferably determined such that a difference between the intermediate thickness dZ produced and the target thickness dZ* will be minimized. In accordance with the diagram shown in FIG. 8 five basic stages would typically be carried out. This is indicated in FIG. 8 with an arrow A.

During the execution of the basic stages the rolling stock 2 is generally rolled longitudinally, meaning that it is not turned between the basic stages. In the rolling pause 9 however it is possible for the rolling stock 2 to be turned by 90° in accordance with the diagram shown in FIG. 2 and thereafter to be rolled transversely. Alternatively it is possible for the rolling stock 2 not to be turned in the rolling pause 9 so that it is also longitudinally rolled during the additional stage. For this reason, namely because both options are provided, the turning of the rolling stock 2 by 90° is only shown in FIG. 2 by dashed lines.

For the sake of clarity it is pointed out that the terms "longitudinal" and "transverse" only serve to distinguish the rolling directions from one another in relation to the rolling stock 2. The basic stages could also be referred to as transverse stages and the additional stages as longitudinal stages. As already mentioned the choice of words is merely used to distinguish between options.

Figure 9:
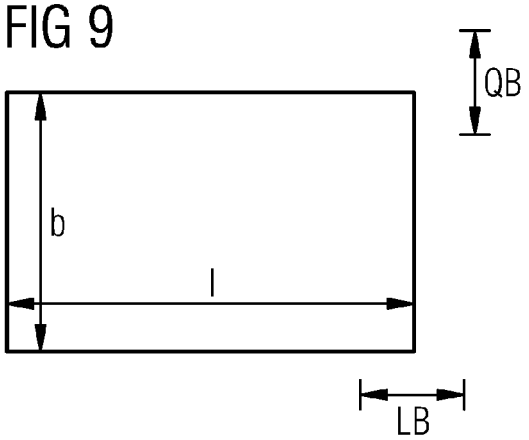
FIG. 9 illustrates a rolling stock viewed from above, according to an example embodiment.

If the rolling stock 2 is rolled longitudinally when rolled from the initial thickness dA to the intermediate thickness dZ and is rolled transversely—at least partly—when rolled from the intermediate thickness dZ to the final thickness dE, the permitted thickness range DB in accordance with FIG. 9 matches a corresponding length range LB, within which a length l of the rolling stock 2 must lie after the rolling stock 2 is rolled to the final thickness dE. In this case it can be possible for the control device 3, within the framework of determining the permitted thickness range DB, initially to determine the permitted longitudinal range LB and then to work back by calculation to the permitted thickness range DB.

In a similar manner the permitted thickness range DB corresponds to a permitted transverse range QB in which a width b of the rolling stock 2 must lie after it has been rolled to the final thickness dE. In a similar manner the permitted thickness range DB can also be worked back to by calculation from the permitted transverse range DB.

Figure 10:
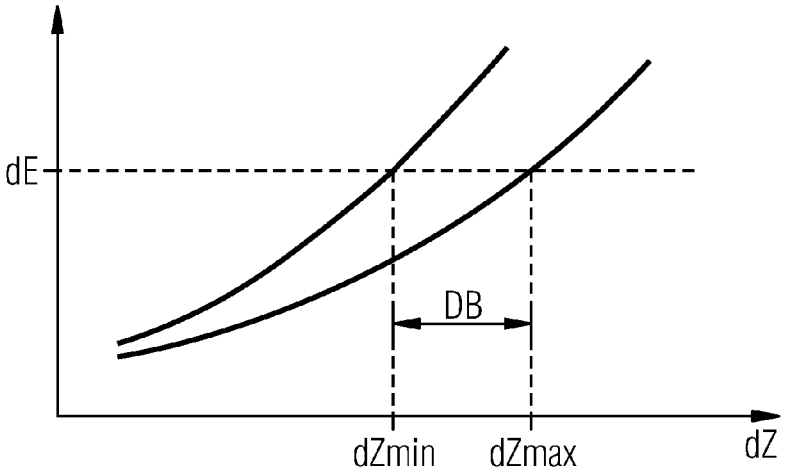
FIG. 10 is a thickness diagram, according to an example embodiment.

If the rolling stock 2 is always rolled longitudinally—i.e., both when rolled from the initial thickness dA to the intermediate thickness dZ and also when rolled from the intermediate thickness dZ to the final thickness dE, it can be possible in accordance with the diagram shown in FIG. 10, that because of the technical facilities of the rolling mill, to roll the rolling stock 2 after the rolling pause 9 to the final thickness dE, the intermediate thickness dZ must lie within specific boundaries. In this case the permitted thickness range DB is determined precisely by these boundaries.

Certain embodiments provide various advantages, e.g., certain embodiments are relatively simple to implement in computing terms, operate efficiently, and are reliable. In some embodiments, there is little or no danger of overloading the rolling mill or of having to carry out "small stages" afterwards so to speak, in which the rolling stock 2 is only deformed to a small extent. Existing rolling mills can also be readily upgraded.

The above description serves exclusively to explain embodiments of the present invention. The scope of protection of the present invention on the other hand is intended to be determined exclusively by the enclosed claims.

What is claimed is:

1. An operating method for a rolling mill for rolling a flat rolling stock from an initial thickness to a final thickness, comprising:

rolling the rolling stock from the initial thickness to an intermediate thickness, inserting a temporal rolling pause, and rolling the rolling stock from the intermediate thickness to the final thickness, wherein the rolling stock is rolled from the initial thickness to the intermediate thickness in a number of reduction stages, and before the rolling stock is rolled, determining a permitted thickness range for the intermediate thickness based on technological boundary conditions, and determining the number of reduction stages for roiling the rolling stock from the initial thickness to the intermediate thickness such that the resulting intermediate thickness lies within the permitted thickness range and either:

(a) the determined number of reduction stages provides that the performance limits of the rolling mill are fully utilized in all reduction stages, or (b) the determined number of reduction stages provides that the performance limits of the rolling mill are not fully utilized in at least one reduction stage, and wherein a rolling process in which the performance limits of the rolling mill were fully utilized for one fewer than the determined number of reduction stages would provide an intermediate thickness that lies outside the permitted thickness range.

2. The operating method of claim 1, comprising predetermining a target thickness lying within the permitted thickness range and, in the event of the performance limits of the rolling mill being fully utilized for all reduction stages, wherein in determining the number of reduction stages, a difference between the intermediate thickness produced and the target thickness is minimized.

3. The operating method of claim 1, wherein, in the event of the performance limits of the rolling mill not being fully utilized in at least one of the reduction stages, starting at the full utilization of the performance limits of the rolling mill, the reduction of the utilization is determined such that the intermediate thickness lies at the lower limit of the permitted thickness range.

4. The operating method of claim 1, wherein, in the event of the performance limits of the rolling mill not being fully utilized in at least one of the reduction stages, the at least one reduction stages not fully utilizing the performance limits of the rolling mill are the last of the reduction stages.

5. The operating method of claim 1, wherein during rolling from the initial thickness to the intermediate thickness the rolling stock is rolled longitudinally, and during rolling from the intermediate thickness to the final thickness the rolling stock is rolled at least partly transversely, and wherein the permitted thickness range is determined by a permitted longitudinal or transverse range of the rolling stock for a corresponding dimension of the rolling stock after being rolled to its final thickness.

6. The operating method of claim 1, wherein during rolling from the initial thickness to the intermediate thickness and also during rolling from the intermediate thickness to the final thickness, the rolling stock is rolled longitudinally, and wherein the permitted thickness range is determined by technical facilities of the rolling mill for rolling the rolling stock to the final thickness after the temporal rolling pause.

7. The operating method of claim 1, wherein the rolling stock is rolled from the initial thickness to the intermediate thickness in a first temperature range, the rolling stock cools down during the temporal rolling pause, and the rolling stock is rolled from the intermediate thickness to the final thickness in at least one second temperature range different from the first temperature range.

8. The operating method of claim 7, wherein the rolling stock is rolled from the intermediate thickness to the final thickness in more than one second temperature range, and wherein a further temporal rolling pause is inserted between two consecutive second temperature ranges, wherein the rolling stock cools down during the further temporal rolling pause.

9. A computer program stored in non-transitory computer-readable media and executable by a control device of a rolling mill to:

determine a permitted intermediate thickness range for a rolling stock based on technological boundary conditions, determine a number of reduction stages for rolling the rolling stock from an initial thickness to an intermediate thickness that lies within the permitted intermediate thickness range, such that either:

(a) the determined number of reduction stages provides that the performance limits of the rolling mill are fully utilized in all reduction stages, or (b) the determined number of reduction stages provides that the performance limits of the rolling mill are not fully utilized in at least one reduction stage, and wherein a rolling process in which the performance limits of the rolling mill were fully utilized for one fewer than the determined number of reduction stages would provide an intermediate thickness that lies outside the permitted thickness range, initiate a rolling of the rolling stock from the initial thickness to an intermediate thickness according to the determined number of reduction stages, initiate a temporal roiling pause, and initiate a rolling of the rolling stock from the intermediate thickness to a final thickness.

10. The computer program of claim 9, executable to predetermine a target thickness lying within the permitted thickness range and, in the event of the performance limits of the rolling mill being fully utilized for all reduction stages, wherein in determining the number of reduction stages, a difference between the intermediate thickness produced and the target thickness is minimized.

11. The computer program of claim 9, wherein, in the event of the performance limits of the rolling mill not being fully utilized in at least one of the reduction stages, starting at the full utilization of the performance limits of the rolling mill, the reduction of the utilization is determined such that the intermediate thickness lies at the lower limit of the permitted thickness range.

12. The computer program of claim 9, wherein, in the event of the performance limits of the rolling mill not being fully utilized in at least one of the reduction stages, the at least one reduction stages not fully utilizing the performance limits of the rolling mill are the last of the reduction stages.

13. The computer program of claim 9, wherein during rolling from the initial thickness to the intermediate thickness the rolling stock is rolled longitudinally, and during rolling from the intermediate thickness to the final thickness the rolling stock is rolled at least partly transversely, and wherein the permitted thickness range is determined by a permitted longitudinal or transverse range of the rolling stock for a corresponding dimension of the rolling stock after being rolled to its final thickness.

14. The computer program of claim 9, wherein during rolling from the initial thickness to the intermediate thickness and also during rolling from the intermediate thickness to the final thickness, the rolling stock is rolled longitudinally, and wherein the permitted thickness range is determined by technical facilities of the rolling mill for rolling the roiling stock to the final thickness after the temporal rolling pause.

15. The computer program of claim 9, wherein the rolling stock is rolled from the initial thickness to the intermediate thickness in a first temperature range, the rolling stock cools down during the temporal rolling pause, and the rolling stock is rolled from the intermediate thickness to the final thickness in at least one second temperature range different from the first temperature range.

16. The computer program of claim 15, wherein the rolling stock is rolled from the intermediate thickness to the final thickness in more than one second temperature range, and wherein a further temporal rolling pause is inserted between two consecutive second temperature ranges, wherein the rolling stock cools down during the further temporal rolling pause.

17. A control device for controlling a rolling process in a rolling mill for a flat rolling stock, the control device including a processor executing nontransitory machine-readable code stored on a tangible medium to:

determine a permitted intermediate thickness range for a rolling stock based on technological boundary conditions, determine a number of reduction stages for rolling the rolling stock from an initial thickness to an intermediate thickness that lies within the permitted intermediate thickness range, such that either:

(a) the determined number of reduction stages provides that the performance limits of the rolling mill are fully utilized in all reduction stages, or (b) the determined number of reduction stages provides that the performance limits of the rolling mill are not fully utilized in at least one reduction stage, and wherein a rolling process in which the performance limits of the rolling mill were fully utilized for one fewer than the determined number of reduction stages would provide an intermediate thickness that lies outside the permitted thickness range.

18. The control device of claim 17, further programmed to:

initiate a rolling of the rolling stock from the initial thickness to an intermediate thickness according to the determined number of reduction stages, initiate a temporal rolling pause, and initiating a rolling of the rolling stock from the intermediate thickness to a final thickness.

* * * * *